US006182300B1

(12) United States Patent
Severance

(10) Patent No.: US 6,182,300 B1
(45) Date of Patent: Feb. 6, 2001

(54) NECK PROTECTIVE GEAR

(76) Inventor: Claude M. Severance, 5515 Edgemere Dr., Torrance, CA (US) 90503

( * ) Notice: Under 35 U.S.C. 154(b), the term of this patent shall be extended for 0 days.

(21) Appl. No.: 09/439,328

(22) Filed: Nov. 12, 1999

(51) Int. Cl.[7] ..... A41D 13/00; A42B 3/00
(52) U.S. Cl. ..... 2/468; 2/461; 2/425
(58) Field of Search ..... 2/459, 461, 462, 2/410, 411, 415, 425, 468

(56) References Cited

U.S. PATENT DOCUMENTS 3,514,784 * 6/1970 McDavid ..... 2/462
4,825,476 * 5/1989 Andrews ..... 2/421
5,353,437 * 10/1994 Field et al. ..... 2/425
5,444,870 * 8/1995 Pinsen ..... 2/425
5,517,699 * 5/1996 Abraham, II ..... 2/425
5,546,601 * 8/1996 Abeyta ..... 2/425

* cited by examiner

*Primary Examiner*—Michael A. Neas

(57) ABSTRACT

A neck protective gear for protecting the neck from injury caused as a result of head impacts especially by football players. The neck protective gear includes a helmet which has a bottom edge extending essentially below both ears and around the back of the user's head and which also has an extensible member which extends downwardly and along the bottom edge and is adapted to at least partially cover the user's neck region, and further includes a set of shoulder pads having an upwardly extending collar which is adapted to receive at least a portion of the extensible member. Any impact to the user's head is transferred from the helmet to the shoulder pads rather than to the user's neck thus reducing probability of serious injury.

6 Claims, 2 Drawing Sheets

NECK PROTECTIVE GEAR

BACKGROUND OF THE INVENTION

1. Field of the Invention

The present invention relates to a special neck protective helmet and shoulder pads and more particularly pertains to a new neck protective gear for protecting the neck from injury caused as a result of head impacts especially by football players.

2. Description of the Prior Art

The use of a special neck protective helmet and shoulder pads are known in the prior art. More specifically, a special neck protective helmet and shoulder pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,189,917; U.S. Pat. No. 4,219,193; U.S. Pat. No. 5,483,698; U.S. Pat. No. 5,371,905; U.S. Pat. No. 5,390,367; and U.S. Pat. No. D249,396.

While these devices fulfill their respective, particular objectives and requirements, the aforementioned patents do not disclose a new neck protective gear. The inventive device includes a helmet which has a bottom edge extending essentially below both ears and around the back of the user's head and which also has an extensible member which extends downwardly and along the bottom edge and is adapted to at least partially cover the user's neck region, and further includes a set of shoulder pads having an upwardly extending collar which is adapted to receive at least a portion of the extensible member. Any impact to the user's head is transferred from the helmet to the shoulder pads rather than to the user's neck thus preventing serious injury.

In these respects, the neck protective gear according to the present invention substantially departs from the conventional concepts and designs of the prior art, and in so doing provides an apparatus primarily developed for the purpose of protecting the neck from injury caused as a result of head impacts especially by football players.

SUMMARY OF THE INVENTION

In view of the foregoing disadvantages inherent in the known types of a special neck protective helmet and shoulder pads now present in the prior art, the present invention provides a new neck protective gear construction wherein the same can be utilized for protecting the neck from injury caused as a result of head impacts especially by football players.

The general purpose of the present invention, which will be described subsequently in greater detail, is to provide a new neck protective gear apparatus and method which has many of the advantages of the a special neck protective helmet and shoulder pads mentioned heretofore and many novel features that result in a new neck protective gear which is not anticipated, rendered obvious, suggested, or even implied by any of the prior art a special neck protective helmet and shoulder pads, either alone or in any combination thereof.

To attain this, the present invention generally comprises a helmet which has a bottom edge extending essentially below both ears and around the back of the user's head and which also has an extensible member which extends downwardly and along the bottom edge and is adapted to at least partially cover the user's neck region, and further includes a set of shoulder pads having an upwardly extending collar which is adapted to receive at least a portion of the extensible member. Any impact to the user's head is transferred from the helmet to the shoulder pads rather than to the user's neck thus preventing serious injury.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new neck protective gear apparatus and method which has many of the advantages of the a special neck protective helmet and shoulder pads mentioned heretofore and many novel features that result in a new neck protective gear which is not anticipated, rendered obvious, suggested, or even implied by any of the prior art a special neck protective helmet and shoulder pads, either alone or in any combination thereof.

It is another object of the present invention to provide a new neck protective gear which may be easily and efficiently manufactured and marketed.

It is a further object of the present invention to provide a new neck protective gear which is of a durable and reliable construction.

An even further object of the present invention is to provide a new neck protective gear which is susceptible of a low cost of manufacture with regard to both materials and labor, and which accordingly is then susceptible of low prices of sale to the consuming public, thereby making such neck protective gear economically available to the buying public.

Still yet another object of the present invention is to provide a new neck protective gear which provides in the apparatuses and methods of the prior art some of the advantages thereof, while simultaneously overcoming some of the disadvantages normally associated therewith.

Still another object of the present invention is to provide a new neck protective gear for protecting the neck from injury caused as a result of head impacts especially by football players.

Yet another object of the present invention is to provide a new neck protective gear which includes a helmet which has a bottom edge extending essentially below both ears and around the back of the user's head and which also has an extensible member which extends downwardly and along the bottom edge and is adapted to at least partially cover the user's neck region, and further includes a set of shoulder pads having an upwardly extending collar which is adapted to receive at least a portion of the extensible member. Any impact to the user's head is transferred from the helmet to the shoulder pads rather than to the user's neck thus preventing serious injury.

Still yet another object of the present invention is to provide a new neck protective gear that allows the user the flexibility without sacrificing safety unlike the prior art.

Even still another object of the present invention is to provide a new neck protective gear that is not clumsy or awkward for the user to wear unlike the prior art.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
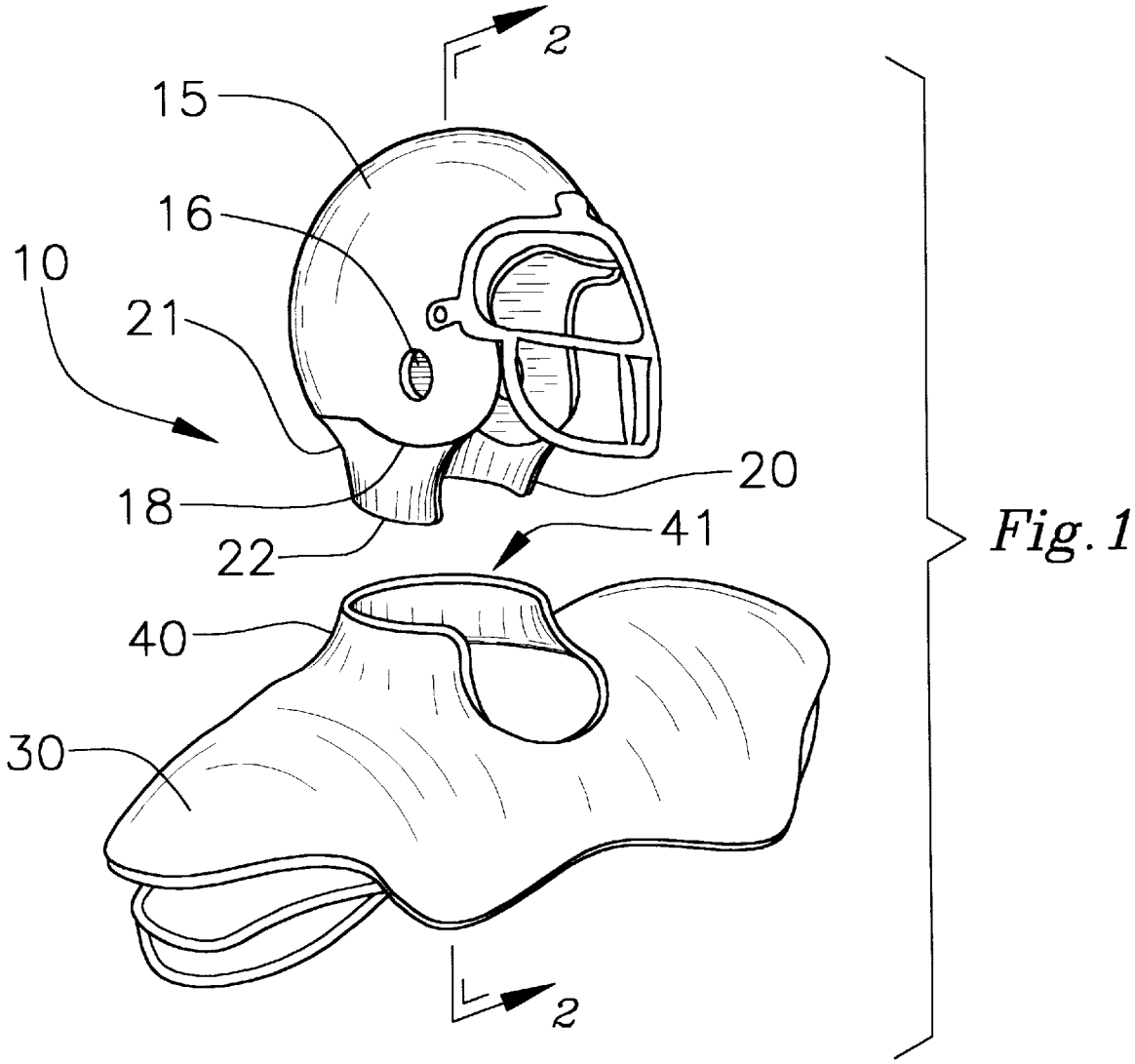
FIG. 1 is a perspective view of a new neck protective gear according to the present invention.
Figure 2:
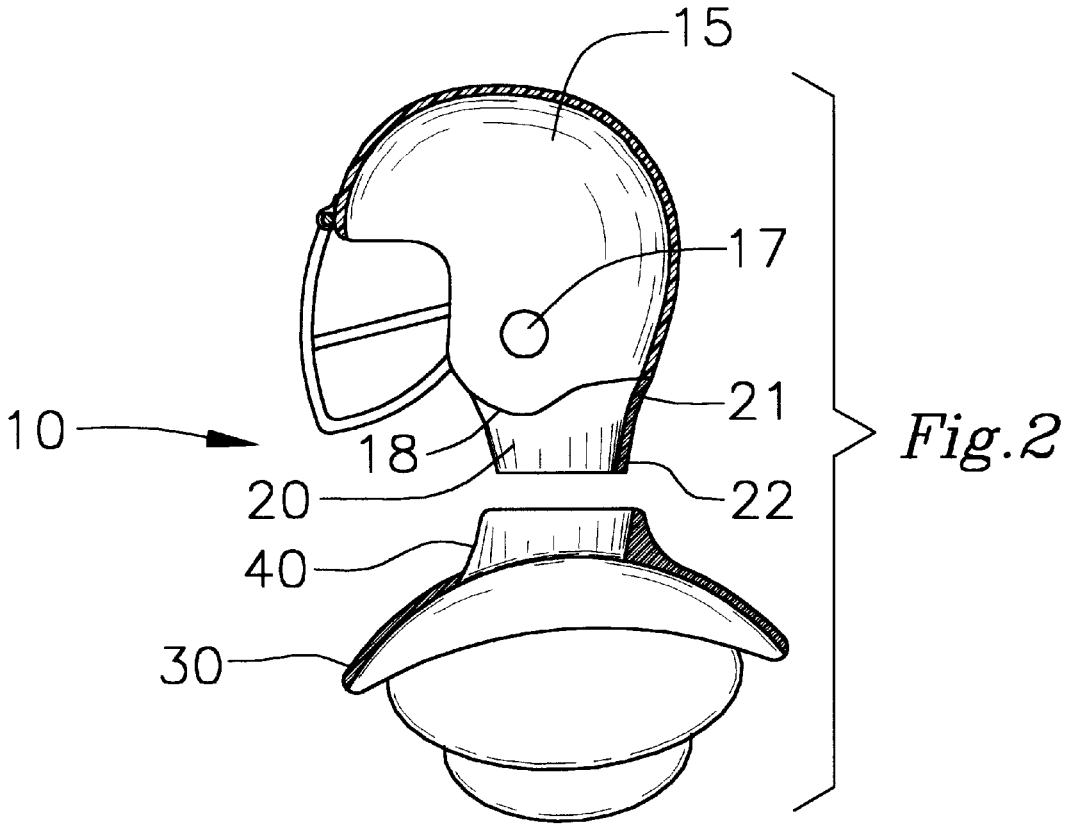
FIG. 2 is a side elevational view of the present invention.
Figure 3:
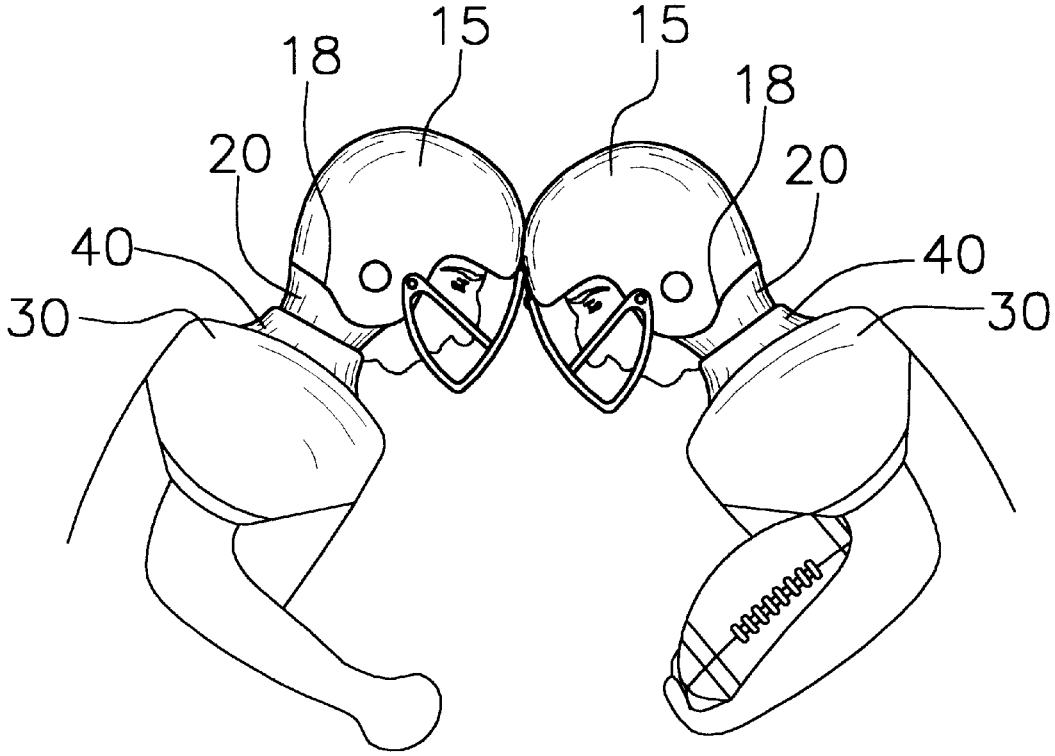
FIG. 3 is a side elevational view of the present invention being used.

With reference now to the drawings, and in particular to FIGS. 1 through 3 thereof, a new neck protective gear embodying the principles and concepts of the present invention and generally designated by the reference numeral 10 will be described.

As best illustrated in FIGS. 1 through 3, the neck protective gear 10 generally comprises a helmet 15 having a bottom edge 18 which essentially extends below both user's ears 16 & 17 and about a back of the user's head and further having an extensible member 20 which integrally extends downwardly from and along the bottom edge 18 of the helmet 15. The extensible member 20 has an inwardly tapered upper portion 21 and a circular lower portion 22. The extensible member 20 being dimensioned and having a width capable of substantially covering the user's neck region 50 when said helmet is worn by the user.

A set of shoulder pads 30 has a collar 40 which extends upwardly to at least cover a portion of the user's neck region 50. The collar 40 defines an opening 41 therein for receiving at least a portion of the lower portion 22 of the extensible member 20 with the collar 40 also being adapted to come into contact with the tapered upper portion 21 of the extensible member 20 when the user receives a blow to one's head as is commonly the occurrence during a football game. The collar 40 and the extensible member 20 are adapted to transfer the impact to the user's head to the collar 40 and to the shoulder pads 30 thus substantially preventing injury to the user's neck region 50. When the user plays football, in particular, the user will commonly hit an opposing player head on or helmet to helmet. When this happens, the user's head is generally forced downwardly onto the shoulders thus causing seriously spinal injury to the user's neck. With this invention, the extensible member 20 in combination with the collar 40 reduces neck impact loads as head is slammed into the shoulders thus reducing the possibility of spinal injury.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A neck protective gear comprising:

a helmet for covering a user's ears and at least partially a user's, head region, said helmet further having an extensible member integrally extending downwardly from and along a bottom edge of said helmet for covering at least a portion of a user's neck region; and a shoulder pad member having a collar integrally extending upwardly from said should pad member for covering at least a portion of a user's neck region, said shoulder pad member having a pair of shoulder portions for covering at least a portion of a user's shoulder, said shoulder pad member having a chest portion for covering at least a portion of a user's chest region and extending between said pair of shoulder portions, said shoulder pad member having a substantially U-shaped opening extending downwardly from an upper edge of said collar into said chest portion towards a bottom edge of said shoulder pad member for allowing forward movement of a user's neck;

wherein said extensible member has an upper portion which is essentially tapered inwardly and is generally rigid.

2. A neck protective gear as described in claim 1, wherein said extensible member has a lower portion which is generally circular and smooth.

3. A neck protective gear as described in claim 2, wherein said collar is adapted to receive at least said lower portion of said extensible member of said helmet.

4. A neck protective gear as described in claim 3, wherein said collar is adapted to essentially come into contact with said tapered upper portion of said extensible member to essentially transfer the impact to the user's head to one's shoulders instead of to one's neck thus reducing probability of injury to the user's neck.

5. A neck protective gear as described in claim 2, wherein said lower portion of said extensible member is adapted to freely rotate within said collar to allow freedom of movement of the user's head.

6. A neck protective gear comprising:

a helmet having a bottom edge which essentially extends below both user's ears and about a back of the user's head and further having an extensible member which integrally extends downwardly from and along said bottom edge of said helmet, said extensible member having an inwardly tapered upper portion and a circular lower portion, said extensible member being dimensioned and having a width capable of substantially covering the user's neck region when said helmet is worn by the user; and a shoulder pad member having a collar which extends upwardly to at least cover a portion of the user's neck region, said collar defining an opening therein for receiving at least a portion of said lower portion of said extensible member, said collar also being adapted to come into contact with said tapered upper portion of said extensible member when the user receives a blow to one's head as is commonly the occurrence during a football game, said collar and said extensible member being adapted to transfer the impact to the user's head to said collar and to said should pad member thus substantially reducing probability of injury to the user's neck, said shoulder pad member having a pair of shoulder portions for covering at least a portion of a user's shoulder, said shoulder pad member having a chest portion for covering at least a portion of a user's chest region and extending between said pair of shoulder portions, said shoulder pad member having a substantially U-shaped opening extending downwardly from an upper edge of said collar into said chest portion towards a bottom edge of said shoulder pad member for allowing forward movement of a user's neck.

* * * * *